US008371138B2

(12) United States Patent
Choi

(10) Patent No.: US 8,371,138 B2
(45) Date of Patent: Feb. 12, 2013

(54) ICE MAKING APPARATUS

(75) Inventor: Seung-Jin Choi, Changwon (KR)

(73) Assignee: LG Electronics Inc., Seoul (KR)

( * ) Notice: Subject to any disclaimer, the term of this patent is extended or adjusted under 35 U.S.C. 154(b) by 972 days.

(21) Appl. No.: 12/441,488

(22) PCT Filed: Sep. 14, 2007

(86) PCT No.: PCT/KR2007/004459

§ 371 (c)(1),
(2), (4) Date: Apr. 16, 2009

(87) PCT Pub. No.: WO2008/033000

PCT Pub. Date: Mar. 20, 2008

(65) Prior Publication Data

US 2009/0314024 A1 Dec. 24, 2009

(30) Foreign Application Priority Data

Sep. 15, 2006 (KR) ..... 10-2006-0089771

(51) Int. Cl.
*F25C 1/00* (2006.01)

(52) U.S. Cl. ..... 62/347

(58) Field of Classification Search ..... 62/353, 62/354, 347, 345
See application file for complete search history.

(56) References Cited

U.S. PATENT DOCUMENTS 5,894,738 A * 4/1999 Choi ..... 62/340
8,272,232 B2 * 9/2012 Kim et al. ..... 62/344

FOREIGN PATENT DOCUMENTS

| | | | |
|---|---|---|---|
| CN | 1282863 | A | 2/2001 |
| CN | 1133858 | C | 1/2004 |
| CN | 1469094 | A | 1/2004 |
| EP | 1382923 | A1 | 1/2004 |
| JP | 2003-279221 | A | 10/2003 |
| JP | 2006-23021 | A | 1/2006 |
| JP | 2006-62705 | A | 3/2006 |
| KR | 10-2000-0002258 | A | 1/2000 |
| KR | 10-2005-0103725 | A | 11/2005 |

* cited by examiner

*Primary Examiner* — Melvin Jones
(74) *Attorney, Agent, or Firm* — Birch, Stewart, Kolasch & Birch, LLP

(57) ABSTRACT

An ice making apparatus is provided. A fluid passage guide is formed in the water supply unit to prevent water discharged from the water supply unit from being splashed to an external side of the tray.

24 Claims, 9 Drawing Sheets

ICE MAKING APPARATUS

TECHNICAL FIELD

The present disclosure relates to an ice making apparatus.

BACKGROUND ART

Generally, a refrigerator is a home appliance that stores food at a low temperature.

The refrigerator has a storage compartment that is opened and closed by a door.

An ice making apparatus for making and storing ice may be installed in the refrigerator. The ice making apparatus includes a tray into which water is supplied and frozen. The water is supplied to the tray through a water supply pipe.

When the water flowing along the water supply pipe turns into a maelstrom, the water may be splashed into an unexpected direction at an outlet of the water supply pipe. When the water is splashed to an outer surface of the tray or other components of the ice making apparatus, ice is created at an undesired place.

DISCLOSURE OF INVENTION

Technical Problem

Embodiments provide an ice making apparatus that can prevent water flowing along a water supply pipe from turning into a maelstrom and thus prevent the water discharged from an outlet of the water supply pipe from being splashed to an outer surface of the tray, thereby preventing ice from being made at an undesired place.

TECHNICAL SOLUTION

In an embodiment, an ice making apparatus includes a water tank storing water; at least one tray in which ice is made; and a water supply unit having at least one fluid passage guide therein and supplying the water to the tray.

In another embodiment, an ice making apparatus includes a water tank storing water; at least one tray in which ice is made; and a water supply unit having at least one fluid passage guide for preventing a vortex phenomenon of the water flowing and supplying the water to the tray.

In still another embodiment, an ice making apparatus includes a water tank storing water; a plurality of trays disposed under the water tank along a vertical direction; and a water supply unit having at least one fluid passage guide therein and supplying the water to the trays, the water supply unit being disposed to be sided in a direction opposite to a direction in which ice is discharged from an upper one of the trays.

In still yet another embodiment, an ice making apparatus includes a water tank storing water; a plurality of trays disposed in zigzag under the water tank along a vertical direction; and a plurality of water supply units each having at least one fluid passage guide therein and supplying the water to the trays.

Advantageous Effects

According to the embodiments, the water discharged from the water supply pipe is not splashed out of the tray or to a circumference of the tray.

BEST MODE FOR CARRYING OUT THE INVENTION

Reference will now be made in detail to the embodiments of the present disclosure, examples of which are illustrated in the accompanying drawings. Although embodiments have been described with reference to a number of illustrative embodiments thereof, it should be understood that numerous other modifications and embodiments can be devised by those skilled in the art that will fall within the spirit and scope of the principles of this disclosure.

Figure 1:
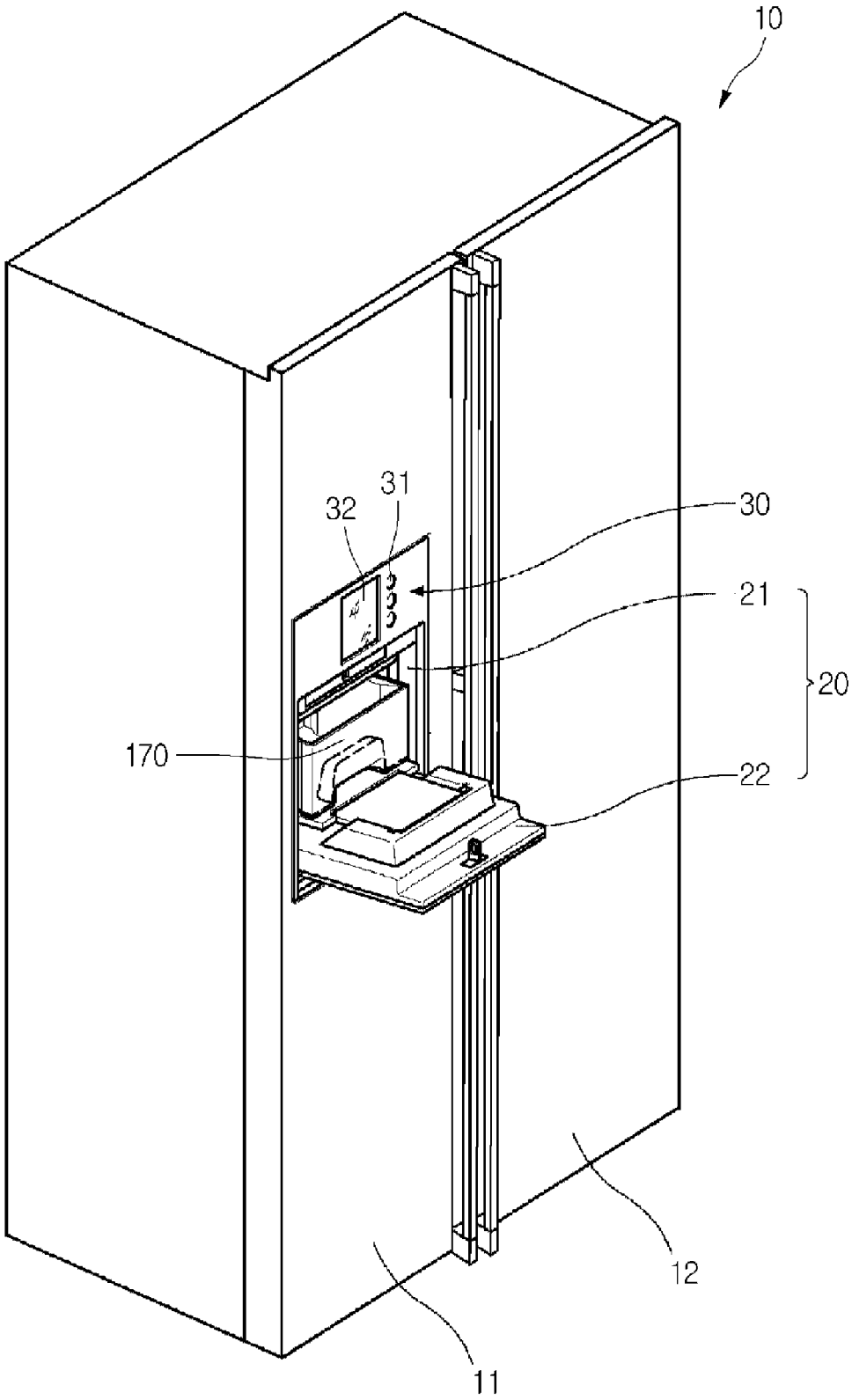
FIG. 1 is a perspective view of a refrigerator according to an embodiment.

FIG. 1 is a perspective view of a refrigerator according to an embodiment.

Referring to FIG. 1, a refrigerator includes a main body 10 defining storage compartments. The storage compartments include a freezing compartment (not shown) and a refrigerating compartment (not shown). Doors 20 and 30 are respectively coupled to front portions of the freezing and refrigerating compartments by hinges.

A home bar 20 is arranged on the door 11 for the refrigerating door. The home bar 20 may include a home bar space 21 formed by depressing the door 11 and a home bar door 22 installed in front of the home bar space 21. The home bar door 22 is hinge-coupled at a lower end to pivotally opened and closed in a vertical direction.

An ice bank 170 is disposed in the home bar space 21. The ice bank 170 may be installed to be capable of moving frontward by a predetermined distance by a link structure or a variety of other structures when the home bar door 22 is opened. Ice discharged from the ice making apparatus 100 is stored in the ice bank 170.

A manipulation unit 30 may be disposed on an upper portion of the home bar 20. The manipulation unit 30 may include a plurality of buttons 31 and a display unit 32. At this point, the display unit 32 displays an operation state of the refrigerator. The buttons 31 may include function selection buttons of the refrigerator, function selection buttons of the ice making apparatus 100, and an ice dispensing button.

Figure 2:
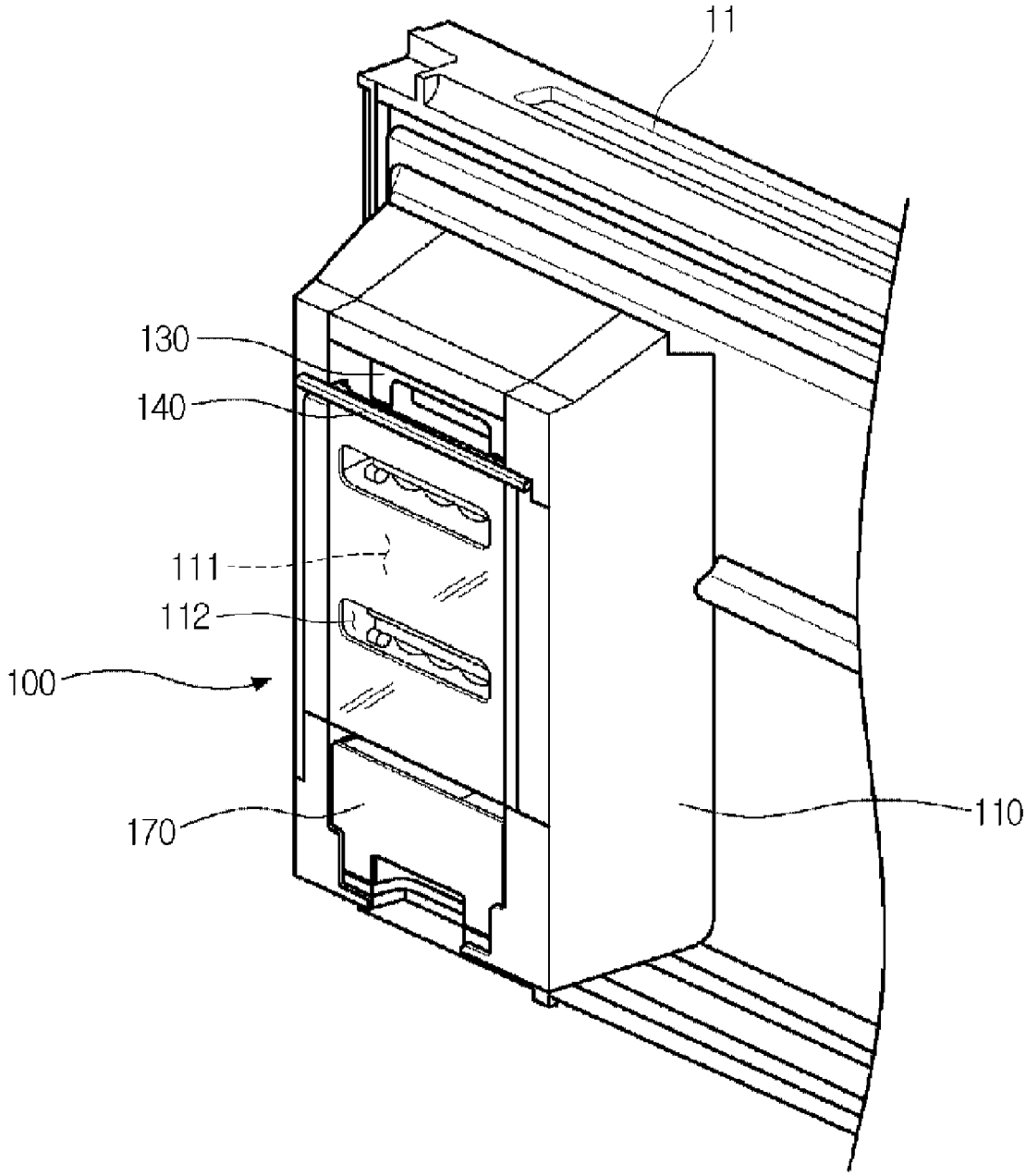
FIG. 2 is a perspective view of an ice making apparatus installed in the refrigerator of FIG. 1.

FIG. 2 is a perspective view of the ice making apparatus installed in the refrigerator of FIG. 1.

Referring to FIG. 2, the ice making apparatus 100 includes an ice making case 110 isolated from the freezing compartment. An ice making chamber 111 is formed in the ice making case 110. A water tank 130 is disposed above the ice making case 110. Cool air inlets 112 through which the cool air of the freezing compartment is introduced are formed on the ice making case 110 near the freezing compartment.

An ice separating lever 120 is installed at a side of the ice making case 110

Figure 3:
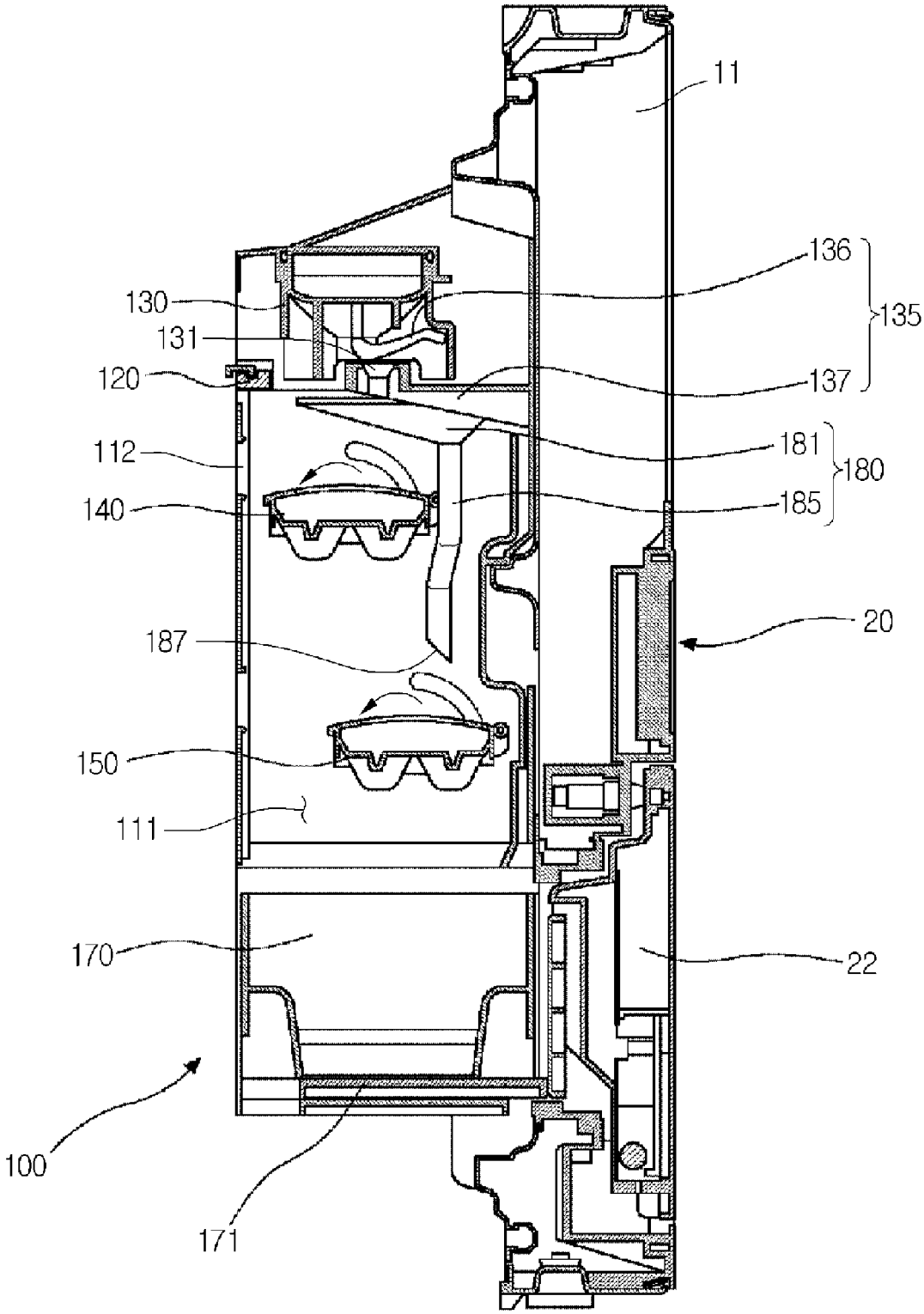
FIG. 3 is a sectional view of the ice making apparatus of FIG. 2.

FIG. 3 is a sectional view of the ice making apparatus of FIG. 2.

Referring to FIG. 3, trays 140 and 150 are disposed in the ice making chamber 111 of the ice making case 110. At this point, the trays 140 and 150 may be disposed in zigzag along a vertical direction of the ice making chamber 111. Although the upper and lower trays 140 and 15 are illustrated in FIG. 3, the number and arrangement of the trays may be varied. The trays 140 and 150 are rotatably installed to discharge the ice downward.

At this point, the air inlet holes 112 formed on the ice making case 110 are formed to correspond to the upper and lower trays 140 and 150. The ice separating lever 120 is arranged on the ice making case 110 at an opposite side of the door 11 to be capable of moving in a vertical direction.

The water tank 130 disposed above the ice making chamber 111 is isolated from the freezing compartment by the ice making case 110 so as to prevent the water stored in the water tank 130 from being frozen by the cool air of the freezing compartment.

Two water dispensing units 131 for supplying the water to the respective upper and lower trays 140 and 150 are formed on a lower portion of the water tank 130. When three or more trays are installed, the number of the water dispensing units 131 corresponds to the number of the trays. In FIG. 3, only one water dispensing unit 131 for supplying the water to the lower tray 150 is illustrated.

The water tank 130 may be divided into two sections and the water dispensing units may be formed in the respective divided sections.

An opening/closing unit 135 for opening and closing the water dispensing units 131 may be provided on the water tank 130. The opening/closing unit 135 includes an opening/closing lever 136 for opening and closing the water dispensing unit 131, an interference lever 137 for moving the opening/closing lever 136 in a vertical direction. The interference lever 137 is driven by an electric unit. When the interference lever 137 lifts the opening/closing lever 136, the opening/closing lever opens the water dispensing units 131 to discharge the water stored in the water tank 130. A valve such as a solenoid valve for opening and closing the water supply units 131 may be used as the opening/closing unit 135.

A water supply unit 180 may be disposed under the water dispensing unit 131. At this point, the water supply unit 180 guides the water discharged through the water dispensing unit 131 to the lower tray 150.

The water supply unit 180 may be disposed to be sided to an opposite side of the ice discharging side of the tray 140.

For example, when the upper tray 140 is disposed such that it can separate the ice toward the ice separating lever 120 by rotating counterclockwise, the water supply unit 180 may be disposed to be sided toward the door 11 for the freezing compartment. At this point, the lower tray 150 may be disposed to be sided to the door 11. Accordingly, the collision of the ice separated from the upper tray 140 with the lower tray 150 and the water supply unit 180 can be prevented.

On the other hand, when the upper tray 140 is disposed such that it can separate the ice toward the ice separating lever 120 by rotating clockwise, the water supply unit 180 may be disposed to be sided toward the ice separating lever 120. At this point, the lower tray 150 may be disposed to be sided to the ice separating lever 120. Accordingly, the collision of the ice separated from the upper tray 140 with the lower tray 150 and the water supply unit 180 can be prevented.

When the upper tray 140 is disposed to be sided to the ice separated lever or the door 11, the water supply unit 180 is disposed going around the upper tray 140 and thus a space extendable toward the lower tray can be obtained. In addition, the upper and lower trays 140 and 150 may rotate in an identical direction.

Further, when three or more trays are installed, the trays may be in zigzag disposed with reference to the vertical direction. For example, the first uppermost tray may be disposed to be sided to the ice separating lever, and the second uppermost tray may be disposed to be sided to the door for the freezing compartment as compared with the first uppermost tray, and the third uppermost tray may be disposed to be further sided to the door for the freezing compartment as compared with the second uppermost tray. Alternatively, the first uppermost tray may be disposed to be sided to the ice separating lever, the second uppermost tray may be disposed to be sided to the door for the freezing compartment, the third uppermost tray may be disposed to correspond to the first uppermost tray, and the fourth uppermost tray may be disposed to correspond to the second uppermost tray.

The water supply unit 180 includes a water collecting unit 181 disposed under the water tank 130 and collecting the water discharged from the water dispensing unit 131 and a water supply pipe 185 extending from a lower portion of the water collecting unit 181 to the trays 140 and 150.

The water collecting unit 181 may be formed in a funnel shape so that the water discharged from the water dispensing unit 131 can be directed to the water supply pipe 185. In addition, an extending end of the water supply pipe 185 may be inclined toward the lower tray 150 so as not to interfere with the rotation of the trays 140 and 150. Accordingly, the extending end of the water supply pipe 185 is disposed close to the upper portion of the lower tray 150 and thus the water discharged from the water supply pipe 185 is not splashed to an external side of the lower tray 150.

The ice bank 170 is disposed under the lower tray 150. The ice bank 170 stores the ice discharged from the upper and lower trays 140 and 150. The lower end of the ice bank 170 is supported by a support panel 171 that can be coupled to the home bar door 22. Hence, when the home bar door 22 is opened, the support panel 171 is taken out of the home bar space 21 and thus the ice bank 170 comes out.

Figure 4:
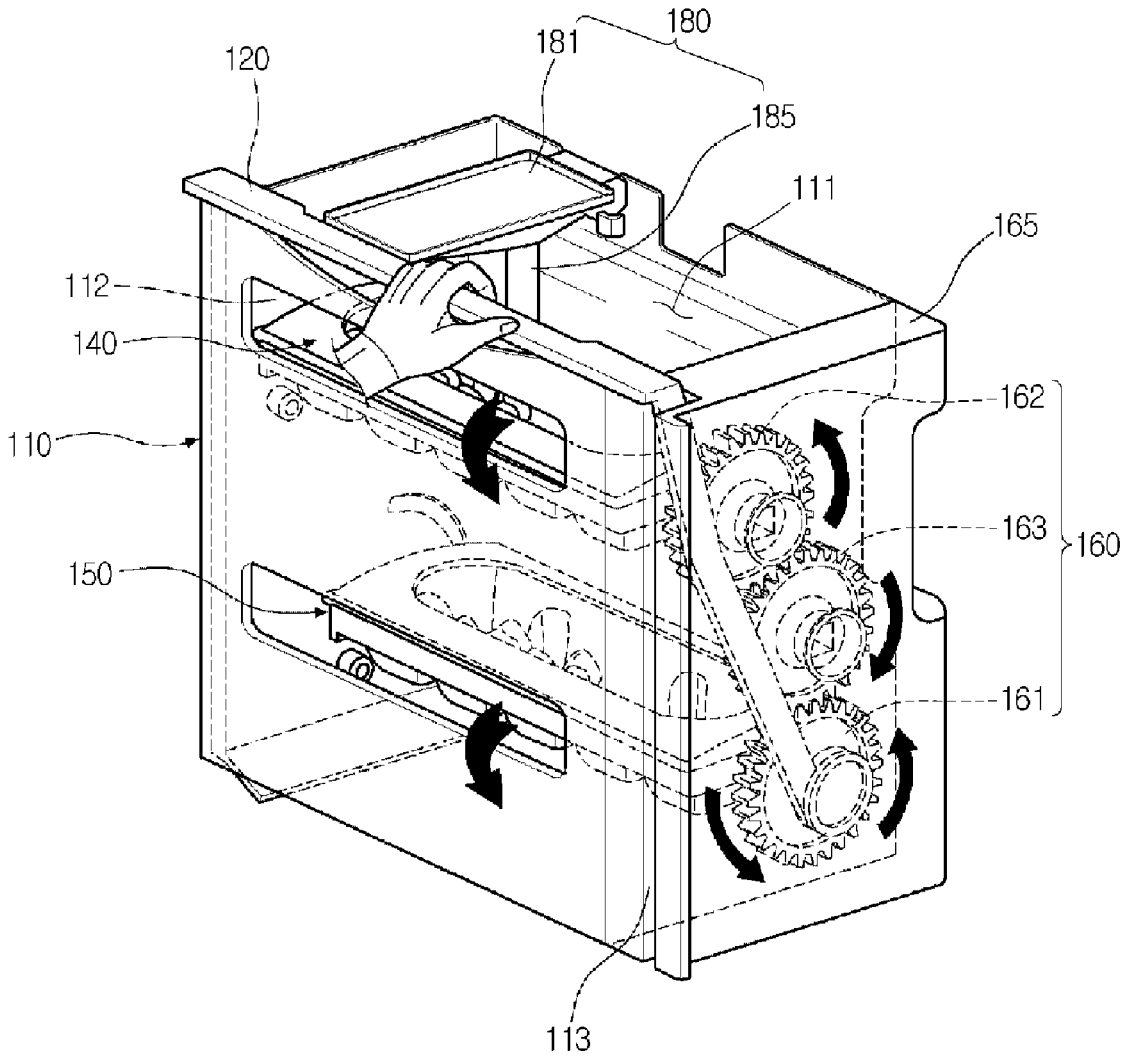
FIG. 4 is a perspective view of the ice making apparatus of FIG. 2.

FIG. 4 is a perspective view of the ice making apparatus.

Referring to FIG. 4, a tray driving unit 160 is disposed at a side of the upper and lower trays 140 and 150. A variety of structures for rotating the trays 140 and 150 may be applied to the tray driving unit 160. In this embodiment, a structure that is designed to allow a user to manually rotate the trays 140 and 150 is provided by way of example.

The tray driving unit 160 is coupled to the ice separating lever 120 so that the user grasps and rotates the ice separating lever 120. At this point, the ice making case 110 is provided with a vertical guide groove 113 so that the ice separating lever 120 can rotate.

The tray driving unit 160 includes tray gears 161 and 162 that are respectively fixed to the trays 140 and 150 and a synchronizing gear 163 engaged with the tray gears 161 and 162. At this point, an end of the ice separating lever 120 is connected to a rotational shaft of the lower tray gear 162. Therefore, when the ice separating lever 120 is pulled downward, the lower tray gear 162 rotates. The lower try gear 162 rotates the synchronizing gear 163 and the upper tray gear 161 and thus the upper and lower trays 140 and 150 are simultaneously rotated in an identical direction.

Here, when the number of the synchronizing gears 160 is an odd number, the upper 140 and lower trays 140 and 150 rotate in an identical direction. When the number of the synchronizing gears 160 is an even number, the upper and lower trays 140 and 150 rotate in different directions. That is, a plurality of synchronizing gears may be provided.

Further, the upper and lower tray gears 161 and 162 and the synchronizing gear 163 may be formed with an identical gear ratio so that the upper and lower trays 140 and 150 can rotate at an identical angle.

The upper and lower tray gears 161 and 162 and the synchronizing gear 163 may be disposed in a gearbox 165 that prevent the gears from being exposed to the trays 140 and 150.

Figure 5:
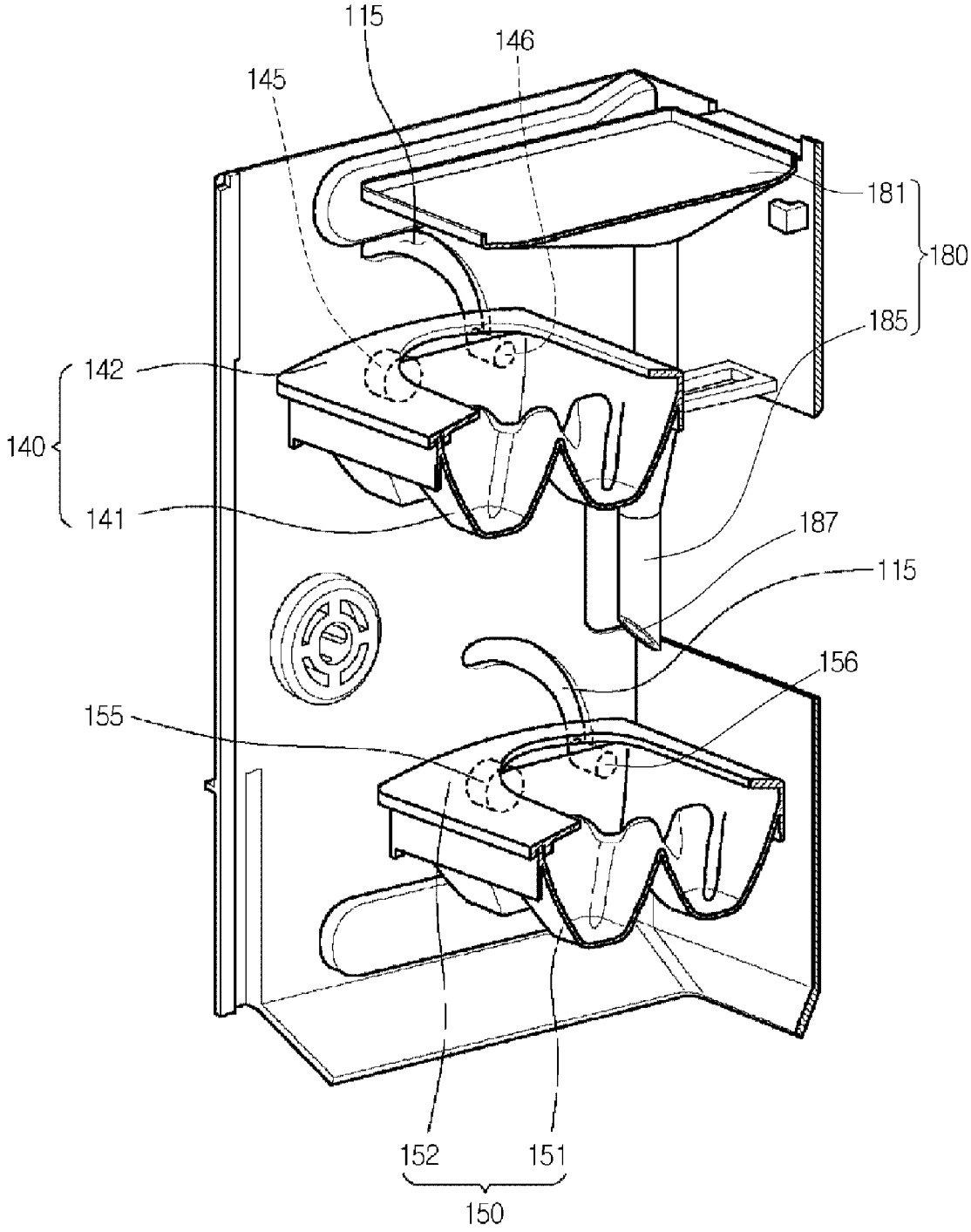
FIG. 5 is a perspective view of the ice making apparatus of FIG. 2.

FIG. 5 is a perspective view of the ice making apparatus of FIG. 2.

Referring to FIG. 5, hinge units 145 and 155 that are rotatably coupled to the ice making case 110 are formed on another side of the respective trays 140 and 150. The hinge units 145 and 155 may be disposed on an axis of the rotational shafts of the tray gears 161 and 162.

Further, guide projections 146 and 156 space apart from the hinge units 145 and 155 are formed on the trays 140 and 150. At this point, the ice making case 110 is provided with a guide slit 115 that corresponds to a rotation track of the guide projections 146 and 156 when the trays 140 and 150 rotate. The guide slit 115 is formed in an arc shape having a radius with respect to the hinge units 145 and 155.

The tray 14, 150 may include a tray body 141, 151 in which the water is frozen and a tray cover 142, 152 coupled to an upper portion of the tray body 141, 151. The tray bodies 141 and 151 are provided with a plurality of ice spaces so as to make a plurality of ice cubes each having a predetermined size.

Further, the tray covers 142 and 152 have openings through which the ice cubes can be discharged. Since the tray covers 142 and 152 encloses upper circumferences of the tray bodies 141 and 151, they can prevent the water from overflowing the tray bodies 141 and 151 when the door 11 for the freezing compartment is opened and closed.

Figure 6:
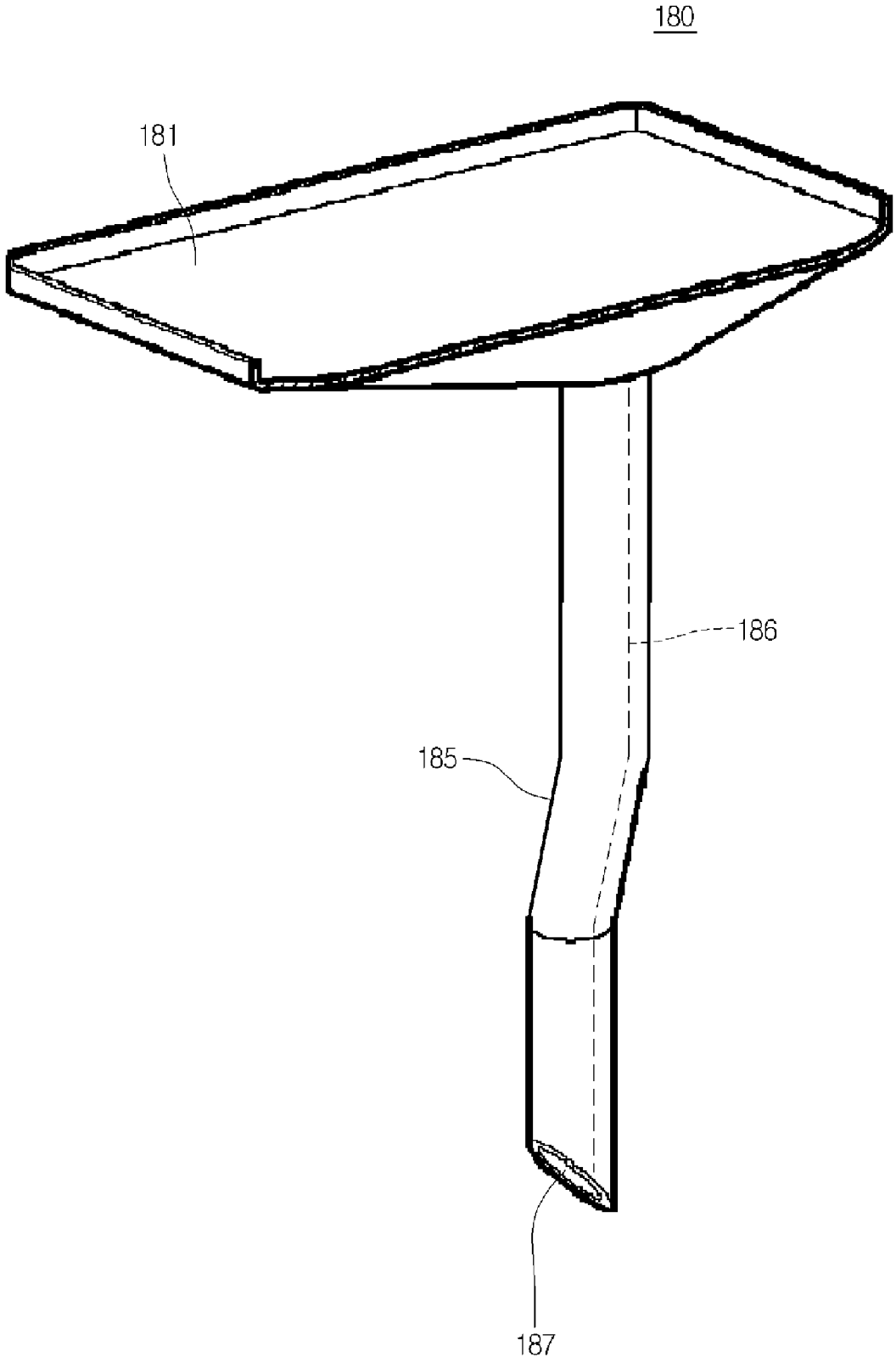
FIG. 6 is a perspective view of a fluid passage guide of the ice making apparatus of FIG. 2 according to an embodiment.
Figure 7:
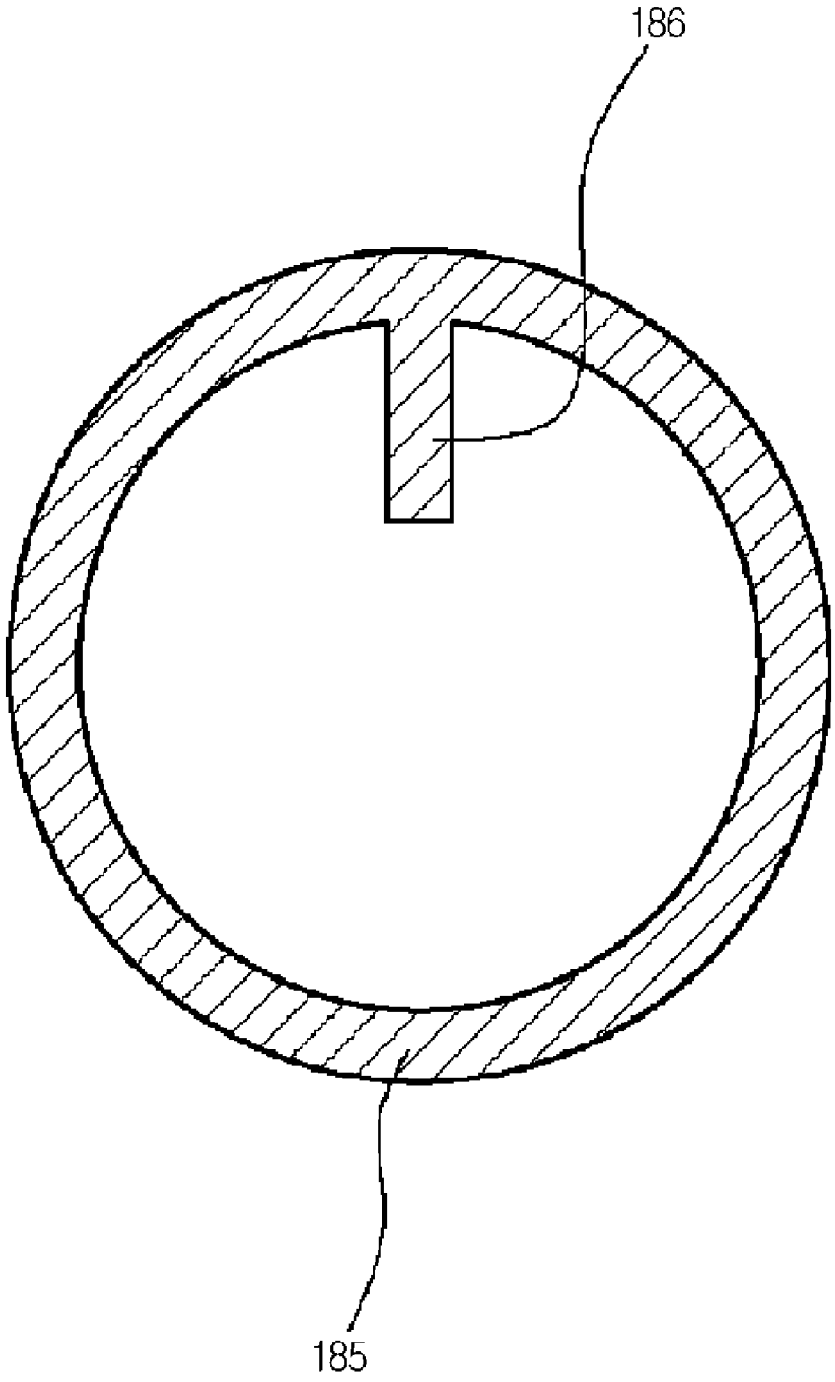
FIG. 7 is a sectional view of the fluid passage guide of FIG. 2.

FIGS. 6 and 7 shows the waters supply unit disposed under the water tank according to an embodiment.

Referring to FIGS. 6 and 7, a fluid passage guide 186 is formed in the water supply unit 180. The fluid passage guide 186 prevents the water flowing along the water supply unit 180 from be splashed upward of the trays 140 and 150 by a vortex phenomenon.

The water supply unit 180 includes the water collecting unit 181 disposed under the water tank 130 and the water supply pipe 185 extending from the lower portion of the water collecting unit 181. A section of the water supply pipe 185 is circular.

The fluid passage guide 186 may be integrally formed with the water supply pipe 185 along the water supply unit 180. The fluid passage guide 186 may protrude toward a center of the water supply pipe 185.

Therefore, the fluid passage guide 186 prevents the water from flowing in a circumferential direction of the water supply pipe 185, thereby preventing the vortex phenomenon in the water supply pipe 185. Further, the fluid passage guide 186 can reduce a flow rate of the water discharged through the water supply pipe 185 as a passage resistance of the water flowing along the water supply pipe 185 acts.

Figure 8:
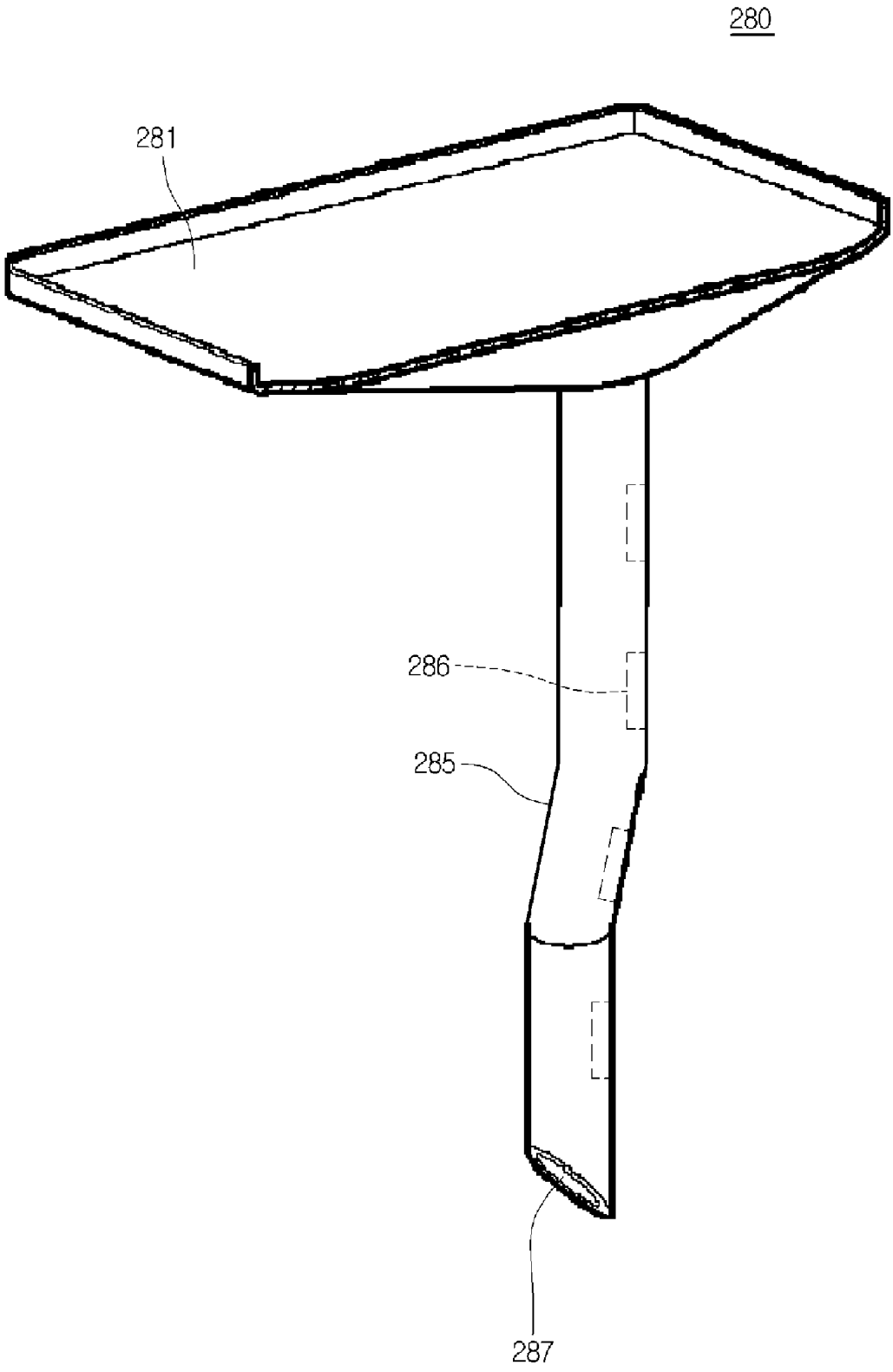
FIG. 8 is a perspective view of a fluid passage guide of the ice making apparatus of FIG. 2 according to another embodiment.

FIG. 8 shows a water supply unit disposed under the water tank according to another embodiment.

Referring to FIG. 8, a water supply unit 280 includes a water collecting unit 281 and a water supply pipe 285.

A plurality of fluid passage guides 286 may be intermittently formed in the water supply pipe 285. At this point, the fluid passage guides 286 may be or may not be disposed inline.

As the fluid passage guides 286 are intermittently formed in the water supply pipe 285, the flow resistance of the water flowing along the water supply pipe 285 may be generated. Therefore, the flow rate of the water discharged to the lower tray 150 may be reduced. Needless to say, the fluid passage guide 286 prevents the generation of the vortex phenomenon where the water flows in the circumferential direction.

Figure 9:
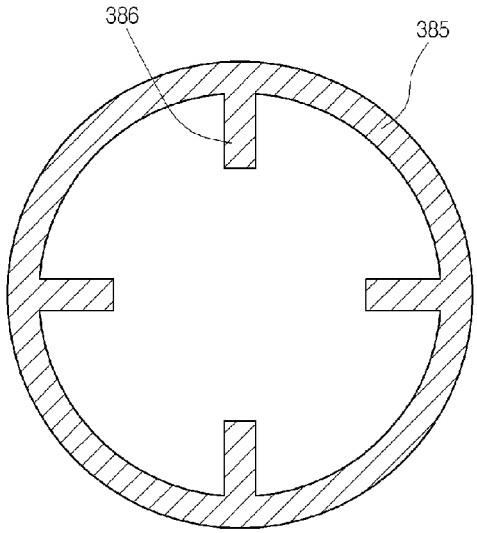
FIG. 9 is a perspective view of a fluid passage guide of the ice making apparatus of FIG. 2 according to another embodiment.

FIG. 9 is a water supply unit disposed under the water tank according to another embodiment. In FIG. 9, since the water collecting unit is identical to that of the foregoing embodiment of FIG. 7, only a water supply pipe is illustrated.

Referring to FIG. 9, a plurality of fluid passage guides 386 are formed in a radial direction. At this point, 7, the fluid passage guides 386 may be intermittently formed along the length of the water supply pipe 385.

As described above, since the fluid passage guides 386 are intermittently formed in the water supply pipe 385 in the radial direction, the vortex phenomenon of the water flowing along the water supply pipe 385 can be prevented. The fluid passage guides 386 formed in the radial direction can reduce the flow rate of the water.

Figure 10:
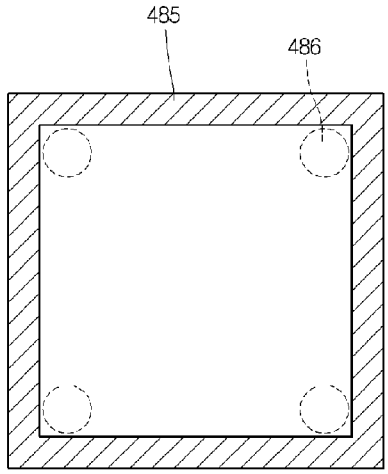
FIG. 10 is a perspective view of a fluid passage guide of the ice making apparatus of FIG. 2 according to another embodiment.

FIG. 10 is a water supply unit disposed under the water tank according to another embodiment. In FIG. 9, since the water collecting unit is identical to that of the foregoing embodiment of FIG. 7, only a water supply pipe is illustrated.

Referring to FIG. 10, a fluid passage guide 486 is formed by depressing a portion of the inner surface of the water supply pipe 485 outward. For example, in order to form the fluid guide passage 486, the water supply pipe 485 may be formed having a square section.

At this point, the corners of the fluid passage guide 486 function to prevent the water from flowing in a circumferential direction. Further, since fluid passage resistance is applied on the corners, the flow rate of the water discharged from the water supply pipe 485 can be reduced.

Figure 11:
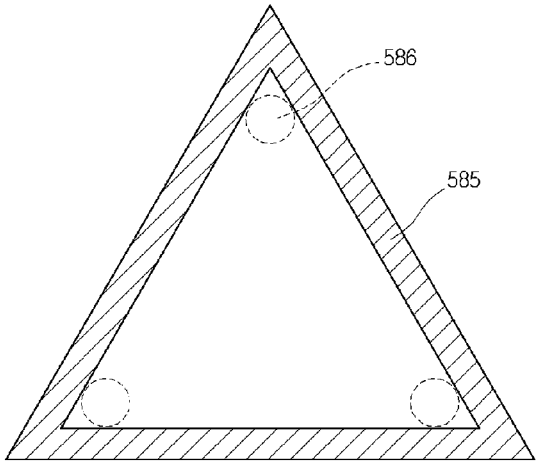
FIG. 11 is a perspective view of a fluid passage guide of the ice making apparatus of FIG. 2 according to another embodiment.

FIG. 11 is a water supply unit disposed under the water tank according to another embodiment. In FIG. 9, since the water collecting unit is identical to that of the foregoing embodiment of FIG. 7, only a water supply pipe is illustrated.

Referring to FIG. 11, a water supply pipe 585 may be formed having a triangular section. The covers of the triangular water supply pipe 585 function to prevent the water from flowing in a circumferential direction. Further, since fluid passage resistance is applied on the corners, the flow rate of the water discharged from the water supply pipe 585 can be reduced.

The water supply pipe may be formed having a polygonal section other than the triangular section and the square section. The water supply pipe may be divided into two sections with reference to the central portion. That is, the water supply pipe may be formed in a variety of structures.

The following will describe operation of the above-described ice making apparatus.

Referring to FIG. 4, after the door 11 for the freezing compartment is opened, the ice making case 110 is opened and takes out the water tank 130. After the water tank 130 is filled with the water, the water tank 130 is mounted on the ice making case 110. Alternatively, the water tank 130 may be designed to be directly supplied with the water from an external water source. In this case, the water tank mounted on the ice making case is connected to the external water source by a hose.

When the water tank 130 is mounted, the opening/closing lever 136 moves upward by the interference lever 137 to open the water discharging unit 131. At this point, the water discharged from the water discharging unit 131 is collected in the water collecting unit 181 and directed to the lower tray through the water supply pipe 185 and the upper tray 140.

At this point, the water flowing along the water supply pipe 185 of the water supply unit 180 is reduced in a component rotating in the circumferential direction by the fluid passage guide 186. Accordingly, the vortex phenomenon of the water can be prevented in the water supply pipe 185. Further, the flow rate of the water is reduced by the passage resistance of the fluid passage guide 186 and thus the splashing of the water on the lower tray 150 can be minimized.

When the water is filled in the upper and lower trays 140 and 150 up to a predetermined water level, the water filled in the trays 140 and 150 is frozen by the cool air.

When the user pulls the ice separating lever 120 after opening the door 11 for the freezing compartment, the upper and lower tray gears 161 and 162 rotates and thus the upper and lower trays 140 and 150 simultaneously rotate in an identical direction. At this point, since the upper and lower trays 140 and 150 rotate while being twisted, the ice cubes are discharged toward the ice bank 170.

At this point, the water supply pipe 185 is disposed at an opposite side to a direction in which the ice cubes are separated from the upper tray 140, the ice cubes do not collide with the water supply pipe 185. Therefore, the damage of the water supply pipe 185 by the ice cubes can be prevented. The ice cubes discharged from the upper and lower trays 140 and 150 are stored in the ice bank 170.

When the user releases the ice separating lever 120, the ice separating lever 120 and the trays 140 and 150 are returned to their initial positions.

The user closes the door 11. In this state, when the user opens the home bar door 22, the ice bank 170 moves frontward so that the user can take the ice cubes out.

INDUSTRIAL APPLICABILITY

According to the present invention, the splashing of the water discharge from the fluid passage guide around the trays can be minimized. In addition, the water can be effectively supplied to the trays. Hence, the industrial applicability is very high.

The invention claimed is:

1. An ice making apparatus comprising:
a water tank storing water;
at least one tray in which ice is made; and
a water tube configured to supply water to the tray, the water tube having a circular shape,
wherein a fluid passage guide is disposed lengthwise along an inner surface of the water tube.

2. The ice making apparatus according to claim 1, wherein the tray is disposed under the water tank.

3. The ice making apparatus according to claim 1, wherein the fluid passage guide is formed protruding from the inner surface of the water tube.

4. The ice making apparatus according to claim 1, wherein the fluid passage guide is intermittently formed along the water tube.

5. The ice making apparatus according to claim 1, wherein a plurality of fluid passage guides are formed on the inner surface of the water tube in a radial direction.

6. The ice making apparatus according to claim 1, wherein the fluid passage guide is formed by depressing the inner surface of the water tube outward.

7. The ice making apparatus according to claim 1, further comprising a water collecting unit disposed under the water tank to collect the water from the water tank and supplying water to the tray.

8. An ice making apparatus comprising:
a water tank storing water;
at least one tray in which ice is made, the tray being disposed under the water tank; and
a water supply unit having at least one fluid passage guide for preventing a vortex phenomenon of the water flowing and supplying the water to the tray.

9. The ice making apparatus according to claim 8, wherein the fluid passage guide is formed on an inner surface of the water supply unit.

10. The ice making apparatus according to claim 8, wherein the fluid passage guide is formed lengthwise along the water supply unit.

11. The ice making apparatus according to claim 8, wherein a plurality of fluid passage guides are intermittently formed along the water supply unit.

12. The ice making apparatus according to claim 8, wherein the fluid passage guide is formed on an inner surface of the water supply unit in a radial direction.

13. The ice making apparatus according to claim 8, wherein the fluid passage guide is formed by depressing an inner surface of the water supply unit outward.

14. The ice making apparatus according to claim 8, wherein the water supply unit comprises:
a water collecting unit disposed under the water tank and collecting the water from the water tank; and
a water supply pipe extending from a lower portion of the water collecting unit toward the tray.

15. An ice making apparatus comprising:
a door;
a housing installed on the door;
a water tank storing water, the water tank detachably mounted on the housing;
a plurality of trays disposed under the water tank along a vertical direction in the housing; and
a plurality of water supply units extended from the water tank to the trays, each having at least one fluid passage guide therein and supplying the water to the trays.

16. An ice making apparatus according to claim 15, wherein a plurality of water dispensing units are formed in the water tank to discharge the water from the respective trays.

17. The ice making apparatus according to claim 15, wherein the fluid passage guide is formed lengthwise along the water supply unit.

18. The ice making apparatus according to claim 15, wherein the fluid passage guide is formed by depressing an inner surface of the water supply unit outward.

19. The ice making apparatus according to claim 15, wherein the water supply unit comprises:
a water collecting unit disposed under the water tank and collecting the water from the water tank; and
a water supply pipe extending from a lower portion of the water collecting unit toward the corresponding tray, the water supply pipe having an end portion that is inclined.

20. The ice making apparatus according to claim 15, wherein an extending end of at least one of the water supply units is disposed close to the trays while not interfering with the trays.

21. The ice making apparatus according to claim 15, wherein a plurality of water dispensing units are formed in the water tank to discharge the water from the respective trays, the number of the water dispensing units being identical to that of the trays.

22. The ice making apparatus according to claim 15, wherein the fluid passage guide is formed protruding from an inner surface of the water supply unit.

23. The ice making apparatus according to claim 15, wherein a plurality of fluid passage guides are intermittently formed along the water supply unit.

24. The ice making apparatus according to claim 15, wherein a plurality of fluid passage guides are formed on an inner surface of the water supply unit in a radial direction.

* * * * *